US009631365B2

(12) United States Patent
Bottin et al.

(10) Patent No.: US 9,631,365 B2
(45) Date of Patent: Apr. 25, 2017

(54) INTERLOCKING WALL PANELS FOR MODULAR BUILDING UNITS

(71) Applicants: Herve Bottin, La Baule (FR); Jean-Marc Deremy, Courbevoie (FR)

(72) Inventors: Herve Bottin, La Baule (FR); Jean-Marc Deremy, Courbevoie (FR)

(73) Assignee: WILLIAMS SCOTSMAN, INC., Baltimore, MD (US)

( * ) Notice: Subject to any disclaimer, the term of this patent is extended or adjusted under 35 U.S.C. 154(b) by 0 days.

(21) Appl. No.: 14/802,073

(22) Filed: Jul. 17, 2015

(65) Prior Publication Data

US 2016/0017606 A1 Jan. 21, 2016

Related U.S. Application Data

(60) Provisional application No. 62/026,256, filed on Jul. 18, 2014.

(51) Int. Cl.
*E04C 2/00* (2006.01)
*E04B 2/00* (2006.01)
(Continued)

(52) U.S. Cl.
CPC ..... *E04C 2/46* (2013.01); *E04B 1/3483* (2013.01); *E04B 1/62* (2013.01); *E04B 2/02* (2013.01);
(Continued)

(58) Field of Classification Search
CPC ..... E04C 2/46; E04C 2/34; E04C 2/30; E04C 2002/004; E04C 2/38; E04F 13/0894; E04B 1/3483; E04B 1/348; E04B 2002/0232; E04B 2/56; E04B 2/02; E04B 1/62; E04H 2001/1283; E04H 1/12; E04H 1/005; E06B 1/52
See application file for complete search history.

(56) References Cited

U.S. PATENT DOCUMENTS 1,522,200 A 1/1925 Masury
2,421,978 A 6/1947 Andrews
(Continued)

FOREIGN PATENT DOCUMENTS

CN 104018583 9/2014
CN 203878747 U 10/2014
(Continued)

OTHER PUBLICATIONS

ModSpace. "Oil & Natural Gas Buildings" http://www.modspace.com/modular-solutions/modular-buildings/industrialenergy/oil-natura . . . Mar. 3, 2015.

*Primary Examiner* — Beth Stephan
(74) *Attorney, Agent, or Firm* — Whiteford, Taylor & Preston, LLP; Gregory M. Stone

(57) ABSTRACT

Disclosed is a modular building construction having interlocking wall panels that mate with one another and with the frame of the building unit without screws, bolts or other fasteners, but while ensuring a water-tight fit. This configuration significantly simplifies installation of the wall panels into the skeletal frame of the modular building unit, allowing a first wall panel to be joined to an adjacent wall panel in a quick and easy installation step while maintaining the ability to later adjust and/or replace the wall panel.

14 Claims, 9 Drawing Sheets

(51) Int. Cl.

| | |
|---|---|
| ***E04H 1/00*** | (2006.01) |
| ***E04C 2/38*** | (2006.01) |
| ***E04H 1/12*** | (2006.01) |
| ***E04B 1/62*** | (2006.01) |
| ***E04B 2/02*** | (2006.01) |
| ***E04B 2/56*** | (2006.01) |
| ***E04B 1/348*** | (2006.01) |
| ***E04C 2/292*** | (2006.01) |

(52) U.S. Cl.

CPC ..... *E04B 2/56* (2013.01); *E04C 2/292* (2013.01); *E04C 2/38* (2013.01); *E04H 1/005* (2013.01); *E04H 1/12* (2013.01); *E04B 2002/0232* (2013.01); *E04H 2001/1283* (2013.01)

(56) References Cited

U.S. PATENT DOCUMENTS

| | | | | |
|---|---|---|---|---|
| 2,787,028 | A | 4/1957 | Webb | |
| 3,224,151 | A | 12/1965 | Nystrom | |
| 3,485,405 | A * | 12/1969 | Dement | B65D 9/32 217/65 |
| 3,821,868 | A * | 7/1974 | Edwards | E04B 1/24 52/241 |
| 3,830,027 | A | 8/1974 | Paisley et al. | |
| 3,971,172 | A | 7/1976 | Gentil | |
| 4,100,703 | A | 7/1978 | Sickler | |
| 4,545,159 | A | 10/1985 | Rizk | |
| 4,637,763 | A | 1/1987 | Van Iperen | |
| 4,644,708 | A | 2/1987 | Baudot et al. | |
| 4,875,595 | A | 10/1989 | Van Valkenburg | |
| 5,004,269 | A | 4/1991 | Pelt | |
| 5,011,152 | A | 4/1991 | Hugunin | |
| 5,070,667 | A * | 12/1991 | Schulte | E04B 1/34321 52/241 |
| 5,145,309 | A | 9/1992 | Foster | |
| 5,193,325 | A | 3/1993 | Allison | |
| 5,317,857 | A | 6/1994 | Allison | |
| 5,519,971 | A * | 5/1996 | Ramirez | E04C 2/52 52/220.2 |
| 5,671,855 | A | 9/1997 | Norman et al. | |
| 5,966,956 | A | 10/1999 | Morris et al. | |
| 6,006,480 | A * | 12/1999 | Rook | E04C 2/2885 52/270 |
| 6,155,747 | A | 12/2000 | Payne et al. | |
| 6,179,522 | B1 | 1/2001 | Sanford et al. | |
| 6,279,955 | B1 | 8/2001 | Fisher | |
| 6,299,008 | B1 | 10/2001 | Payne | |
| 6,434,890 | B1 * | 8/2002 | Konnerth | E04B 2/7401 52/169.5 |
| 6,502,357 | B1 * | 1/2003 | Stuthman | E04B 2/7448 52/239 |
| 6,837,007 | B2 | 1/2005 | Floyd et al. | |
| 7,827,738 | B2 | 11/2010 | Abrams et al. | |
| 8,397,441 | B2 | 3/2013 | Wallance | |
| 8,402,704 | B2 | 3/2013 | Hartley et al. | |
| 8,561,367 | B2 | 10/2013 | Kelly | |
| 8,642,900 | B2 | 2/2014 | Nordling et al. | |
| 2006/0037280 | A1 | 2/2006 | Smith | |
| 2007/0138173 | A1 | 6/2007 | Nielsen | |
| 2007/0271857 | A1 * | 11/2007 | Heather | B65D 88/005 52/79.9 |
| 2008/0134589 | A1 * | 6/2008 | Abrams | E04B 1/003 52/79.1 |
| 2008/0251403 | A1 | 10/2008 | Nielsen | |
| 2008/0307739 | A1 * | 12/2008 | Clucas | E04B 1/14 52/580 |
| 2009/0193735 | A1 * | 8/2009 | Kalinowski | E04B 2/60 52/281 |
| 2009/0223143 | A1 | 9/2009 | Esposito | |
| 2009/0223153 | A1 | 9/2009 | MacGregor | |
| 2009/0229194 | A1 | 9/2009 | Armillas | |
| 2011/0162293 | A1 * | 7/2011 | Levy | E04B 1/3483 52/79.9 |
| 2011/0173925 | A1 * | 7/2011 | Brown | E04B 1/14 52/794.1 |
| 2011/0260533 | A1 | 10/2011 | Hardin | |
| 2011/0297675 | A1 | 12/2011 | Johnson et al. | |
| 2012/0006369 | A1 | 1/2012 | Cantin | |
| 2012/0037198 | A1 | 2/2012 | Cantin et al. | |
| 2012/0077429 | A1 | 3/2012 | Wernimont et al. | |
| 2012/0180403 | A1 * | 7/2012 | Kull | F21K 9/30 52/79.1 |
| 2012/0255241 | A1 | 10/2012 | Nishikawa et al. | |
| 2012/0306236 | A1 | 12/2012 | Skipper et al. | |
| 2013/0305648 | A1 * | 11/2013 | Spear | E04F 13/0894 52/588.1 |
| 2014/0000183 | A1 | 1/2014 | Parren et al. | |
| 2014/0090312 | A1 | 4/2014 | Medley | |
| 2014/0213169 | A1 | 7/2014 | Rasmussen et al. | |
| 2014/0223840 | A1 * | 8/2014 | Wheeler | E04B 1/343 52/79.9 |
| 2014/0259971 | A1 | 9/2014 | Bikker | |
| 2014/0298745 | A1 | 10/2014 | Rechenmacher et al. | |
| 2015/0033639 | A1 | 2/2015 | Wilson | |
| 2015/0075271 | A1 | 3/2015 | Tracy et al. | |
| 2015/0101258 | A1 | 4/2015 | Milo et al. | |
| 2015/0152634 | A1 | 6/2015 | Unger | |
| 2015/0159363 | A1 | 6/2015 | Ehsasi | |
| 2015/0259938 | A1 | 9/2015 | Bernard | |

FOREIGN PATENT DOCUMENTS

| | | | | |
|---|---|---|---|---|
| EP | 2674538 | A1 | 12/2013 | |
| EP | 2674538 | B1 | 12/2014 | |
| FI | EP 1426518 | A1 * | 6/2004 | E04C 2/292 |
| FR | 2563858 | | 11/1985 | |
| GB | EP 1312729 | A1 * | 5/2003 | E04B 1/3483 |
| WO | 93/11328 | | 6/1993 | |
| WO | 93/19262 | | 9/1993 | |
| WO | 9506609 | | 3/1995 | |
| WO | 97/44541 | | 11/1997 | |
| WO | 2008/027234 | | 3/2008 | |
| WO | 2011/113102 | | 9/2011 | |
| WO | 2012/068800 | | 5/2012 | |

* cited by examiner

INTERLOCKING WALL PANELS FOR MODULAR BUILDING UNITS

CROSS REFERENCE TO RELATED APPLICATION

This application is based upon and claims benefit of U.S. Provisional Patent Application Ser. No. 62/026,256 entitled "WALL PANEL ASSEMBLY FOR MODULAR BUILDING UNITS," filed with the U.S. Patent and Trademark Office on Jul. 18, 2014 by the inventor herein, the specification of which is incorporated herein by reference in its entirety.

FIELD OF THE INVENTION

This invention relates generally to modular building construction, and more particularly to a system of interlocking wall panels in a modular building unit.

BACKGROUND OF THE INVENTION

Modular buildings typically comprise a skeletal metal (e.g., steel) frame that supports a number of elements allowing easy transportation, construction, and customization of the building unit. Those elements typically include a solid roof and floor and wall panels that are inserted into the frame. In order to provide access into the building unit, a door is typically provided on at least one of the walls of the building unit. In typical configurations, wall panels are attached to the frame by providing, for example, an upwardly opening U-shaped profile bracket attached to a flooring member, which U-shaped bracket receives the bottom of a wall panel that is configured with a rectangular base. Alternatively, specialized brackets have been provided and attached by screws or bolts to a flooring member, which specialized brackets may have a particular geometric profile to push a similarly configured portion of a wall panel against the flooring member. In still other configurations, wall panels have simply been attached by screws, bolts, or other connectors directly to the flooring member. In each case, such installation of wall panels into a frame of a modular building unit is time consuming, requiring multiple steps to ensure a sufficient connection is made between the panel and the rest of the assembly. Moreover, if it is later desired, either during the installation process or after placement of the modular building unit, to modify the position of a panel, move a panel, or replace a panel, such is not easily accomplished given the fixed connection to the frame of the modular building unit.

Thus, there remains a need in the art for a modular building unit construction that allows fitment of wall panels in a manner that avoids the need for permanent connectors between the wall panel and the frame, thus allowing adjustment and/or replacement of the wall panels after their initial installation, but that nonetheless provides a water-tight seal to prevent moisture infiltration into the modular building unit.

SUMMARY OF THE INVENTION

Disclosed is a system of interlocking wall panels for modular building units. The wall panels are configured for easy installation into the skeletal frame of the modular building unit, and are provided with mating male and female connecting edges on opposite sides of each panel, and top and bottom profiles that allow water-tight placement without the use of screws, bolts, or other fasteners. This allows a first wall panel to be joined to an adjacent wall panel in a quick and easy installation step while maintaining the ability to later adjust and/or replace the wall panel.

In accordance with certain aspects of an embodiment of the invention, an interlocking wall panel system for modular building units is disclosed, comprising: a plurality of wall panels of identical construction, each wall panel further comprising: an external sheet and an internal sheet; a vertical tongue extending along a first vertical edge of the wall panel and formed by a first edge of each of the external sheet and the internal sheet; a vertical groove extending along a second vertical edge of the wall panel and formed by a second edge of each of the external sheet and the internal sheet, wherein the vertical groove of a first panel is configured to mate with the vertical tongue of an adjacent panel to form a connected edge in which the external sheets of adjacent panels are in contact and coplanar with one another, and the internal sheets of adjacent panels are in contact and coplanar with one another; and a bottom profile having an upwardly extending notch configured to engage an upwardly extending ridge on a lower frame member of a modular building unit.

In accordance with further aspects of an embodiment of the invention, a modular building unit is provided comprising: a rigid, fixed modular building unit frame having a plurality of corner support posts, a bottom rail extending between adjacent pairs of corner support posts, a top rail extending between adjacent pairs of corner support posts, and a plurality of wall panels extending between the corner support posts, the top rails, and the bottom rails; wherein each wall panel further comprises: an external sheet and an internal sheet; a vertical tongue extending along a first vertical edge of the wall panel and formed by a first edge of each of the external sheet and the internal sheet; a vertical groove extending along a second vertical edge of the wall panel and formed by a second edge of each of the external sheet and the internal sheet, wherein the vertical groove of a first panel is configured to mate with the vertical tongue of an adjacent panel to form a connected edge in which the external sheets of adjacent panels are in contact and coplanar with one another, and the internal sheets of adjacent panels are in contact and coplanar with one another; and a bottom profile having an upwardly extending notch configured to engage an upwardly extending ridge on the bottom rail of the modular building unit frame.

BRIEF DESCRIPTION OF THE DRAWINGS

The numerous advantages of the present invention may be better understood by those skilled in the art by reference to the accompanying drawings in which.

DETAILED DESCRIPTION OF THE PREFERRED EMBODIMENTS

The following description is of a particular embodiment of the invention, set out to enable one to practice an implementation of the invention, and is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
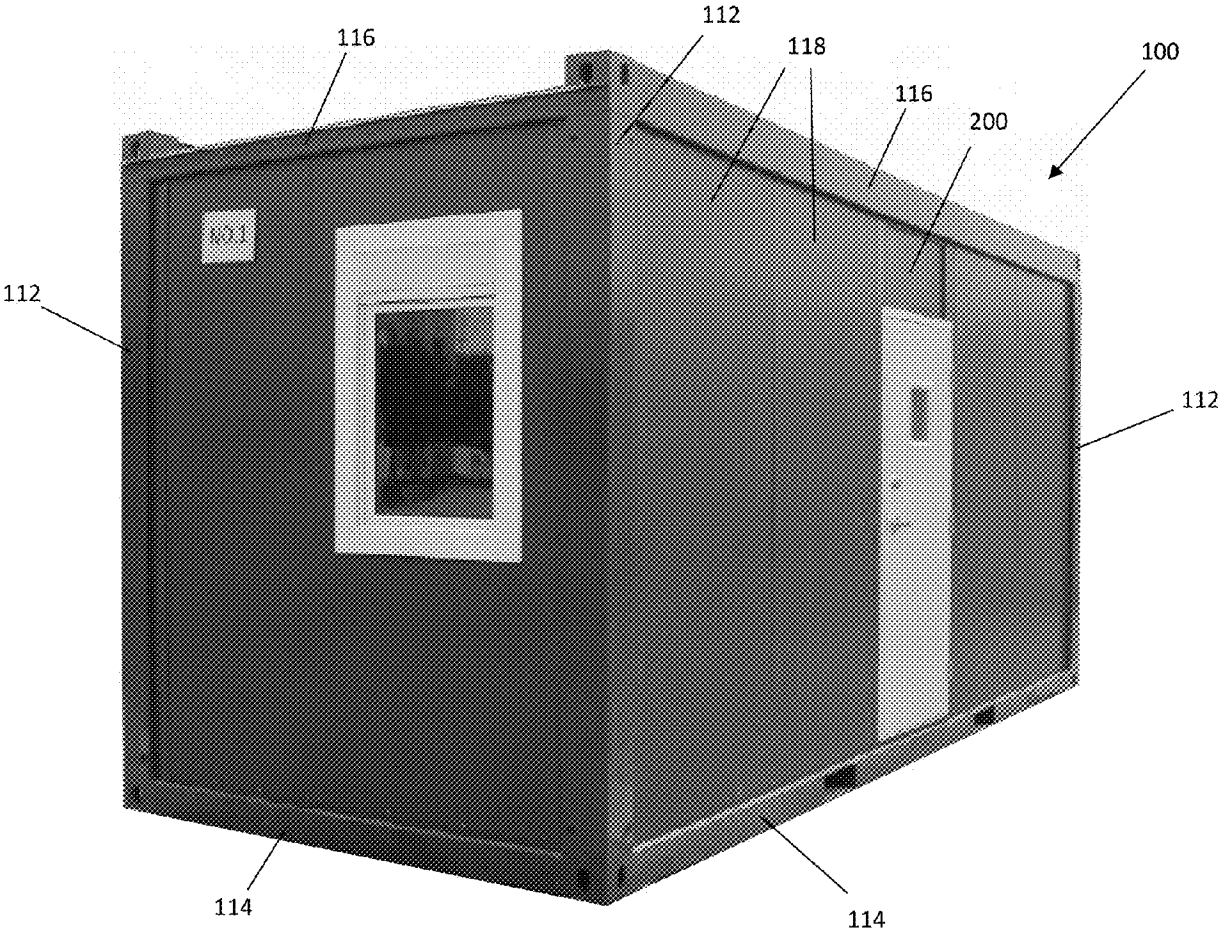
FIG. 1 is a perspective view of a modular building unit in accordance with certain aspects of an embodiment of the invention.

FIG. 1 provides a perspective view of a modular building unit 100 in accordance with certain aspects of an embodiment of the invention. Modular building unit 100 includes a skeletal frame formed by corner support posts 112, bottom rails 114, and top rails 116, wall panels 118, windows 120, and door panels 200. This skeletal frame provides the key structural integrity for the modular building unit. As shown in FIG. 1, wall panels 118 are positioned between corner support posts 112, bottom rails 114, and top rails 116, which wall panels 118 form the wall structures spanning each side of the modular building unit.

Figure 2:
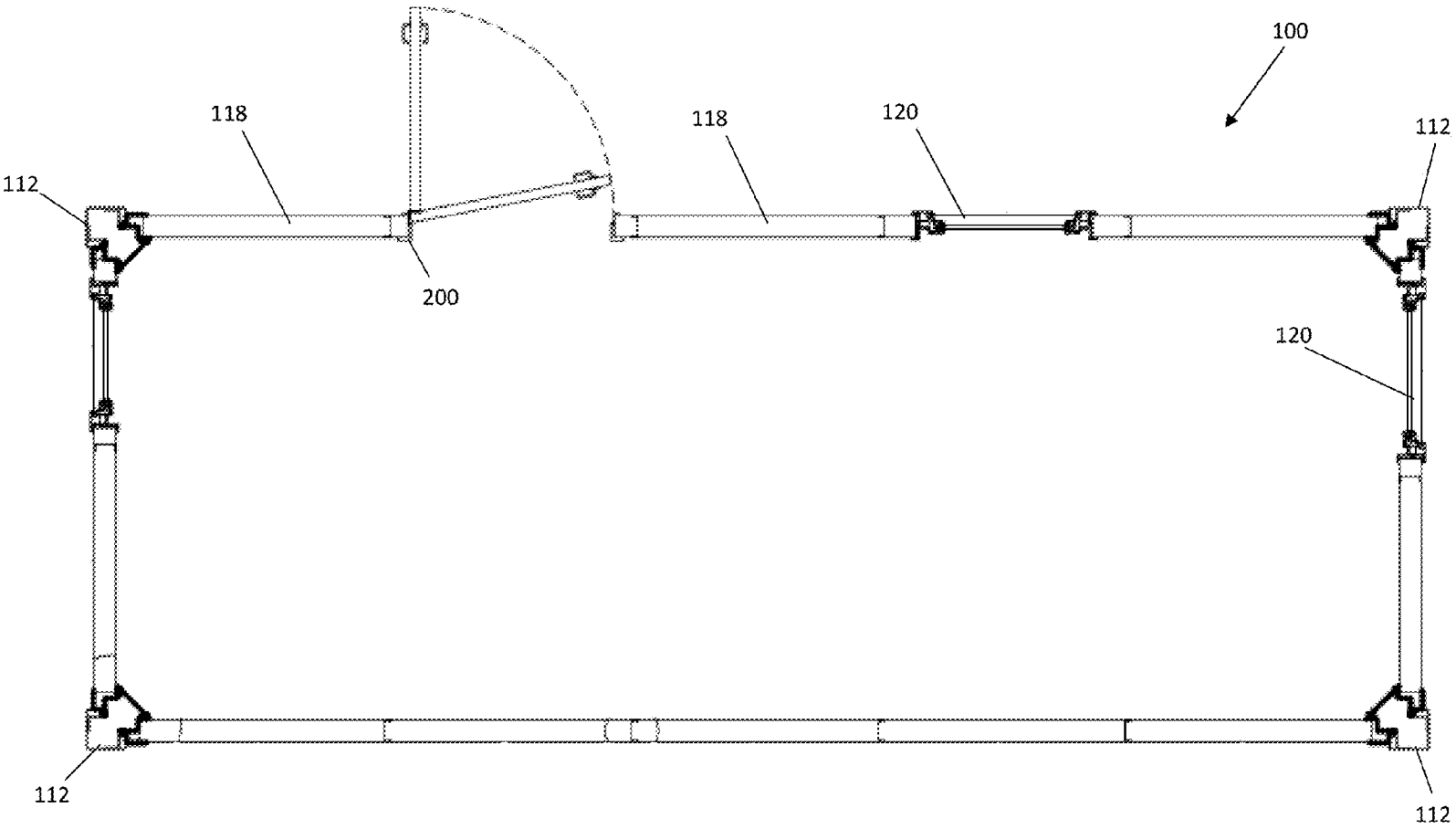
FIG. 2 is a top down, sectional view of an exemplary configuration for the modular building unit of FIG. 1.
Figure 3:
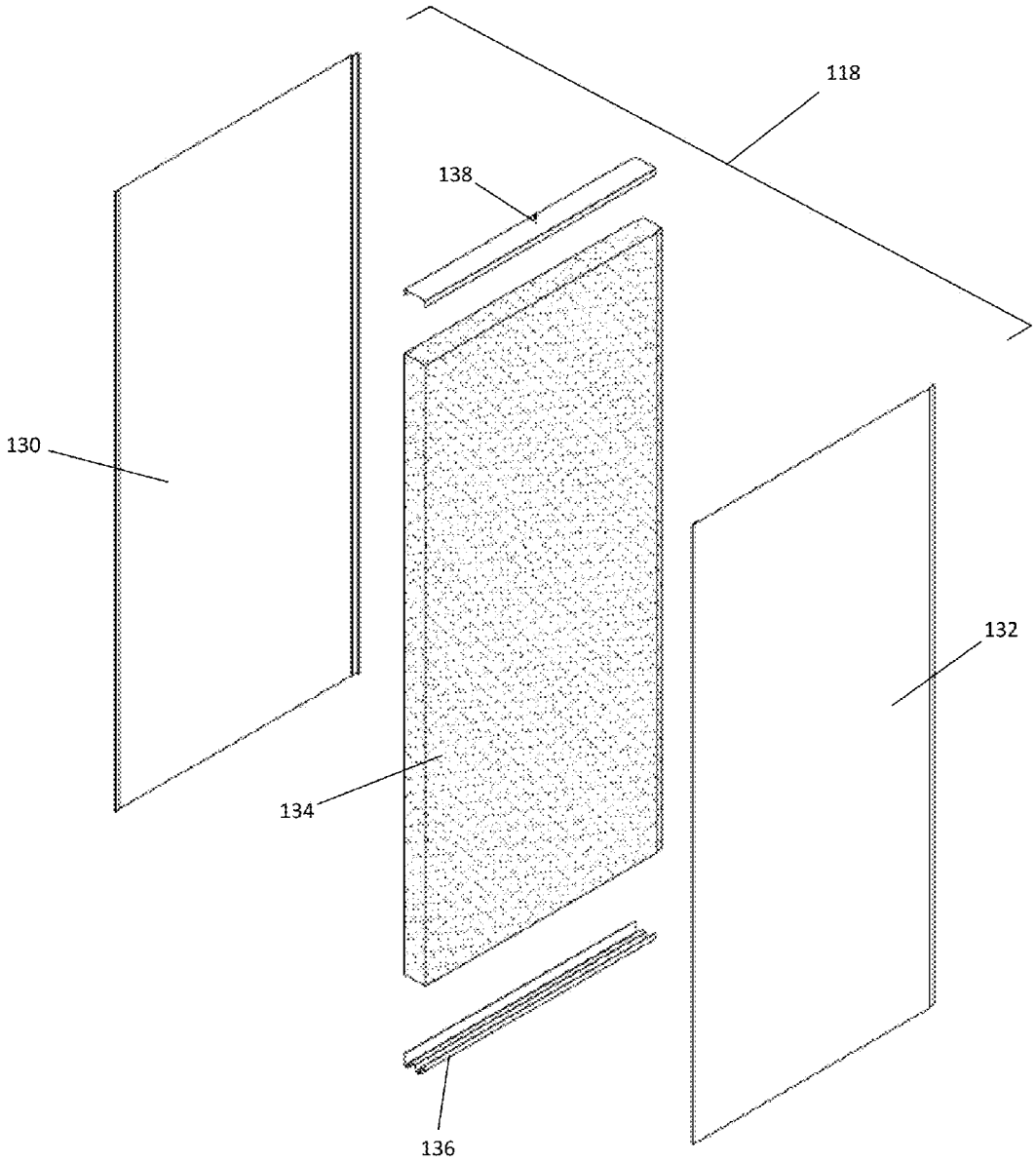
FIG. 3 is an exploded view of a wall panel for use with the modular building unit of FIG. 1.

FIG. 2 is a top down, sectional view of the modular building unit 100. As shown in FIG. 2, wall panels 118 are joined to one another, and to both corner brackets 112 and door panel 200, by edge profiles, the construction of which is described in detail below. With continued reference to FIG. 2 and to the exploded view of a wall panel 118 of FIG. 3, each wall panel 118 is comprised of an external sheet 130 which forms the exterior wall surface of the modular building unit 100, an internal sheet 132 which forms the interior wall surface of the modular building unit 100, and an insulation panel 134 positioned between external sheet 130 and internal sheet 132 providing added rigidity to each wall panel 118, in addition to thermal insulation for the modular building unit 100. With particular reference to FIG. 3, wall panels 118 also include a bottom profile 136 for joining wall panel 118 to bottom rails 114 of the frame of the modular building unit 100 (which bottom profile 136 may optionally be joined by rivets, screws, glue, or other fastening devices), and a top profile 138 for joining wall panel 118 to top rails 116 of the frame of the modular building unit 100.

Figure 4:
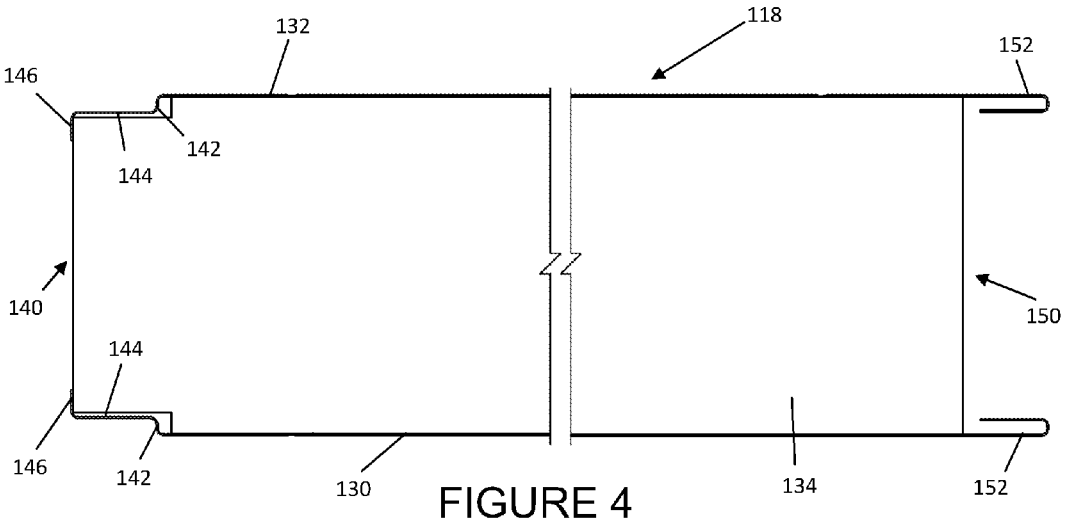
FIG. 4 is a top down, cross-sectional view of an assembled wall panel of FIG. 3.
Figure 8:
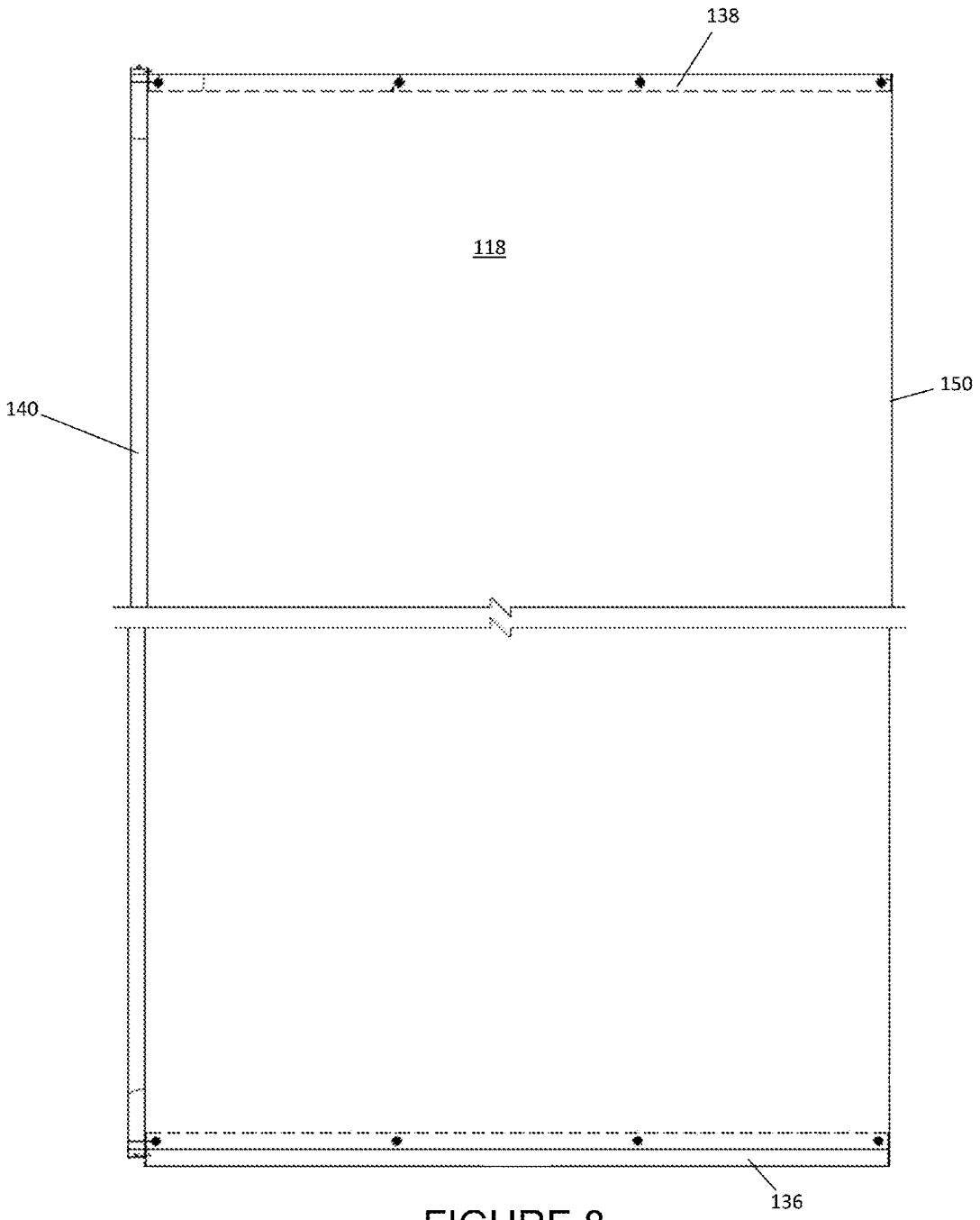
FIG. 8 is a front view of a wall panel of FIG. 3.

FIG. 4 provides a top down, cross-sectional view of an assembled wall panel 118, and FIG. 8 provides a front view of an assembled wall panel 118. Each wall panel 118 has a first side edge comprising a male profile 140, and a second, opposite side edge comprising a female profile 150. Male profile 140 is configured to engage with female profile 150 on an adjacent wall panel 118 in a tongue-and-groove mating connection. Male profile 140 extends from both external sheet 130 and internal sheet 132, and includes an inwardly bent leg 142 and a tongue wall 144 extending outward from leg 142 in a direction generally parallel to each of external sheet 130 and internal sheet 132 so as to form a sidewall of the tongue of male profile 140. An inwardly extending flange 146 may also be provided extending inward from tongue wall 144. Insulation panel 134 preferably has a complementary male profile adjacent male profile 140, such that inwardly extending flanges 146 may overlap the edge of insulation panel 134. Likewise, female profile 150 extends from the opposite ends of both external sheet 130 and internal sheet 132 so as to form sidewalls of female profile 150, and is defined by two u-shaped end walls 152. Each u-shaped end wall 152 is sized to fit within the open space between tongue wall 144 and the outer wall of the respective external and internal sheet 130 and 132.

Figure 5:
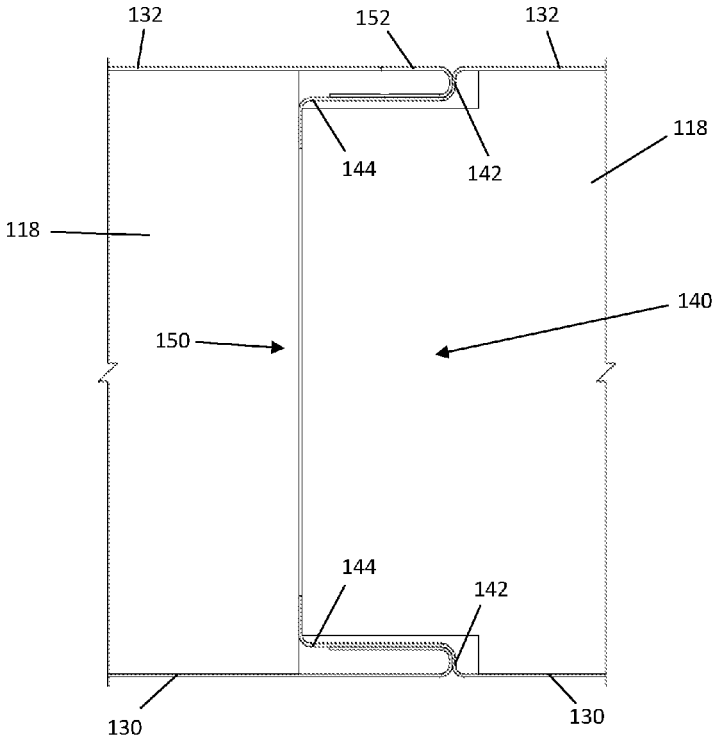
FIG. 5 is a top view of the joining of two mated wall panels of FIG. 4.

FIG. 5 shows two such wall panels 118 mated together with the male profile 140 of the panel on the right in FIG. 5 engaging the female profile 150 of the wall panel on the left in FIG. 5. As shown in FIG. 5, the interior face of u-shaped end wall 152 sits flush against the exterior face of tongue wall 144 of the adjacent panel, such that the outer faces of adjacent external sheets 130 and internal sheets 132 are aligned. Likewise, the distal end of each u-shaped end wall 152 abuts leg 142 of male profile 140 of the adjacent wall panel.

Figure 6:
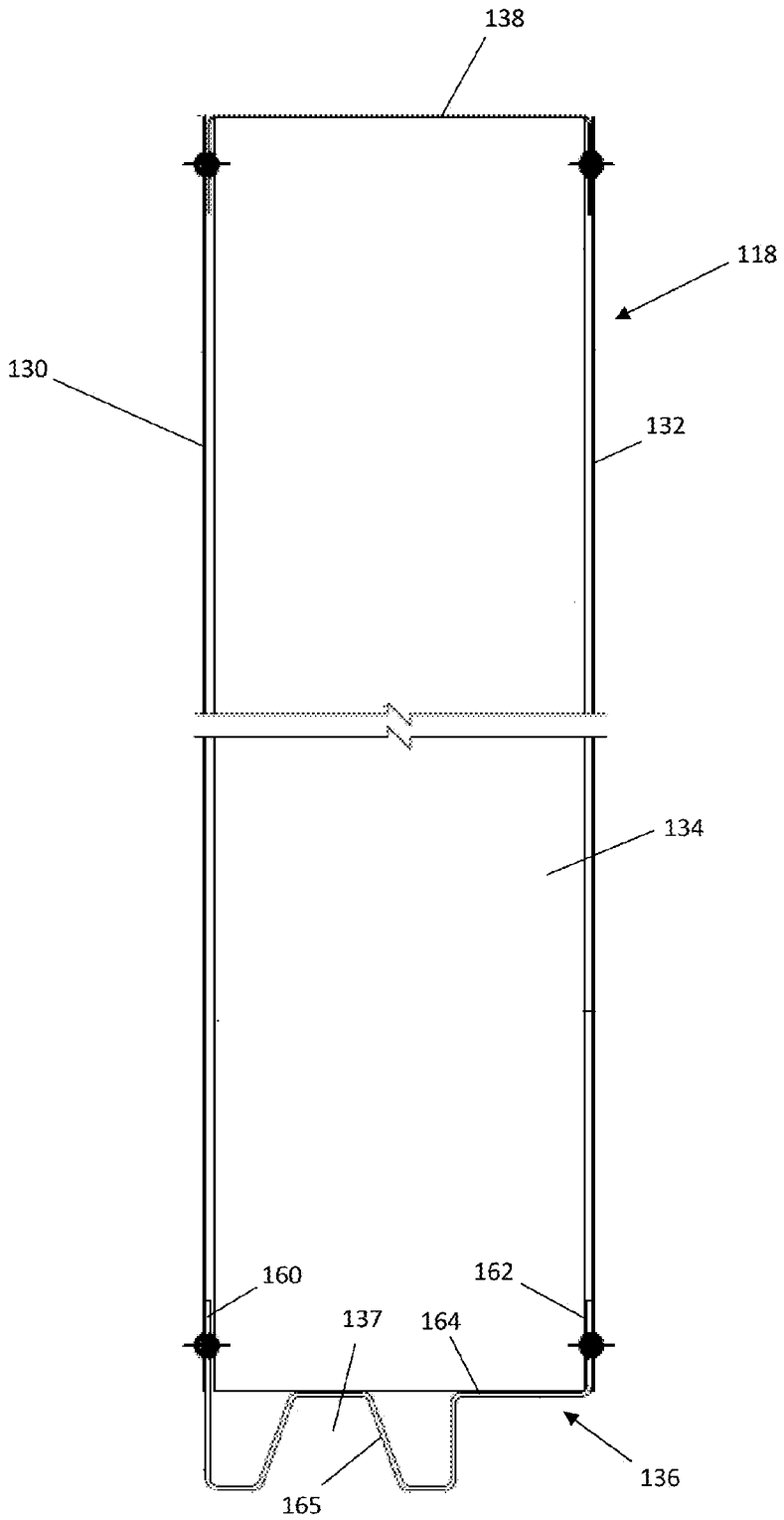
FIG. 6 is a side view the wall panel of FIG. 4.

FIG. 6 shows a side view of wall panel 118, again including external sheet 130 shown on the left side of FIG. 6 and internal sheet 132 shown on the right side of FIG. 6, with insulation panel 134 positioned between them. Likewise, a bottom wall panel profile 136 is provided closing the bottom of wall panel 118, and a top wall panel profile 138 is provided closing the top of wall panel 118.

Figure 9:
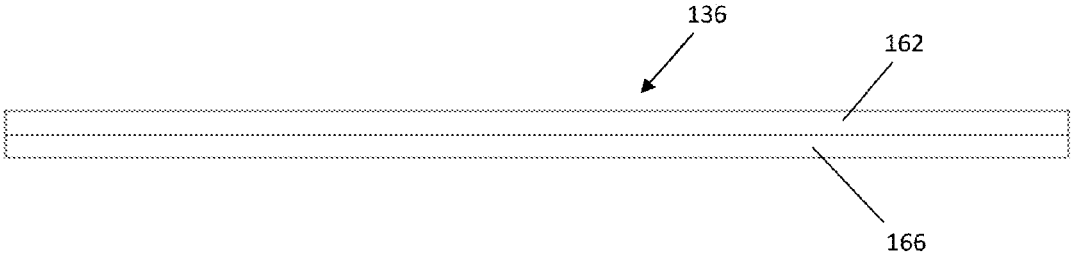
FIG. 9 is a front view of a bottom profile of a wall panel of FIG. 3.
Figure 10:
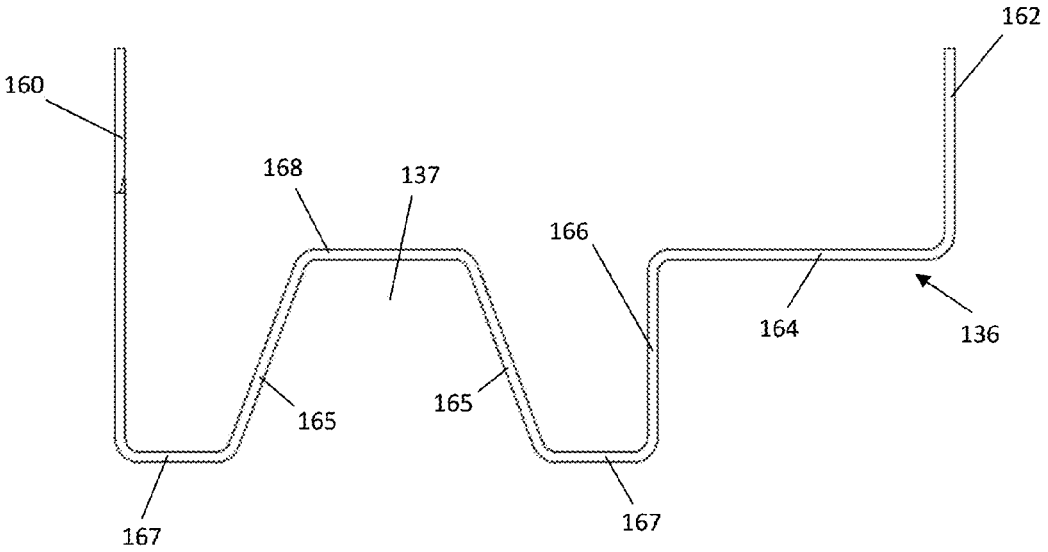
FIG. 10 is a cross-sectional view of the bottom profile of FIG. 9.

With continued reference to FIG. 6, and to the front view of bottom wall panel profile 136 of FIG. 9 and the cross-sectional view of bottom wall panel profile 136 of FIG. 10, profile 136 includes a front wall 160 having a top portion that is positioned between external sheet 130 and insulation panel 134, and a lower portion extending downward from the bottom of external sheet 130. Bottom wall panel profile 136 likewise includes a back wall 162 extending between internal sheet 132 and insulation panel 134. An internal ledge 164 extends outward from back wall 162 and sits adjacent to a bottom edge of insulation panel 134. Vertical wall 166 extends downward from internal ledge 164 to a bottom wall 167, which bottom wall 167 is configured to abut the bottom rail 114 of the frame of the modular building unit. Further, a bottom rail engaging extension is formed by angled walls 165 extending upward from bottom wall 167 and a second horizontal ledge 168. Angled walls 165 and second horizontal ledge 168 together form a notch 137 configured to receive a ridge 115 on bottom rail 114, as discussed in greater detail below with respect to FIG. 7. Likewise, internal ledge 164 and second horizontal ledge 168 together support the bottom edge of insulation panel 134.

Figure 11:
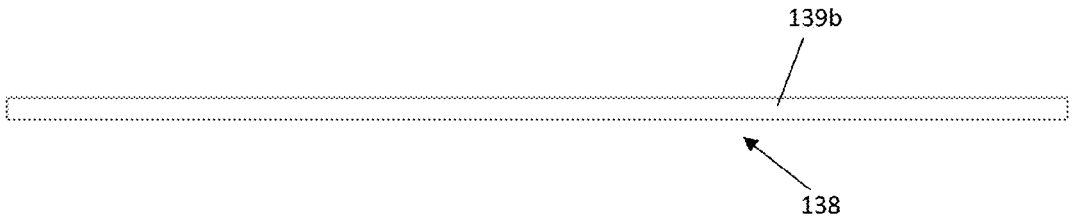
FIG. 11 is a front view of a top profile of a wall panel of FIG. 3.
Figure 12:
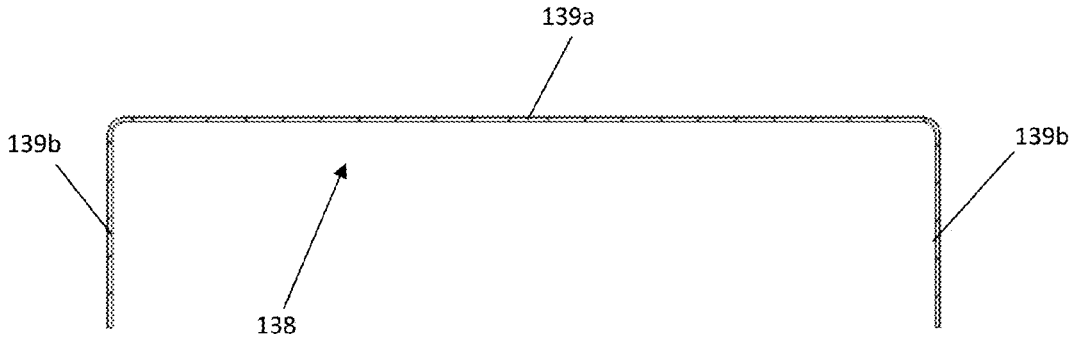
FIG. 12 is a cross-sectional view of the top profile of FIG. 11.

Likewise, with reference to both FIGS. 3 and 6, and to the front view of top wall panel profile 138 of FIG. 11 and the cross-sectional view of top wall panel profile 138 of FIG. 12, top wall panel profile 138 is comprised of a planar top wall **139*a* and downwardly extending sidewalls 139*b* that are positioned between insulation panel 134 and each of external sheet 130 and internal sheet 132. This top wall panel profile provides a block structure that may be inserted into an open, generally rectangular space formed at the top of the frame, as discussed below with regard to FIG. 7**.

Figure 7:
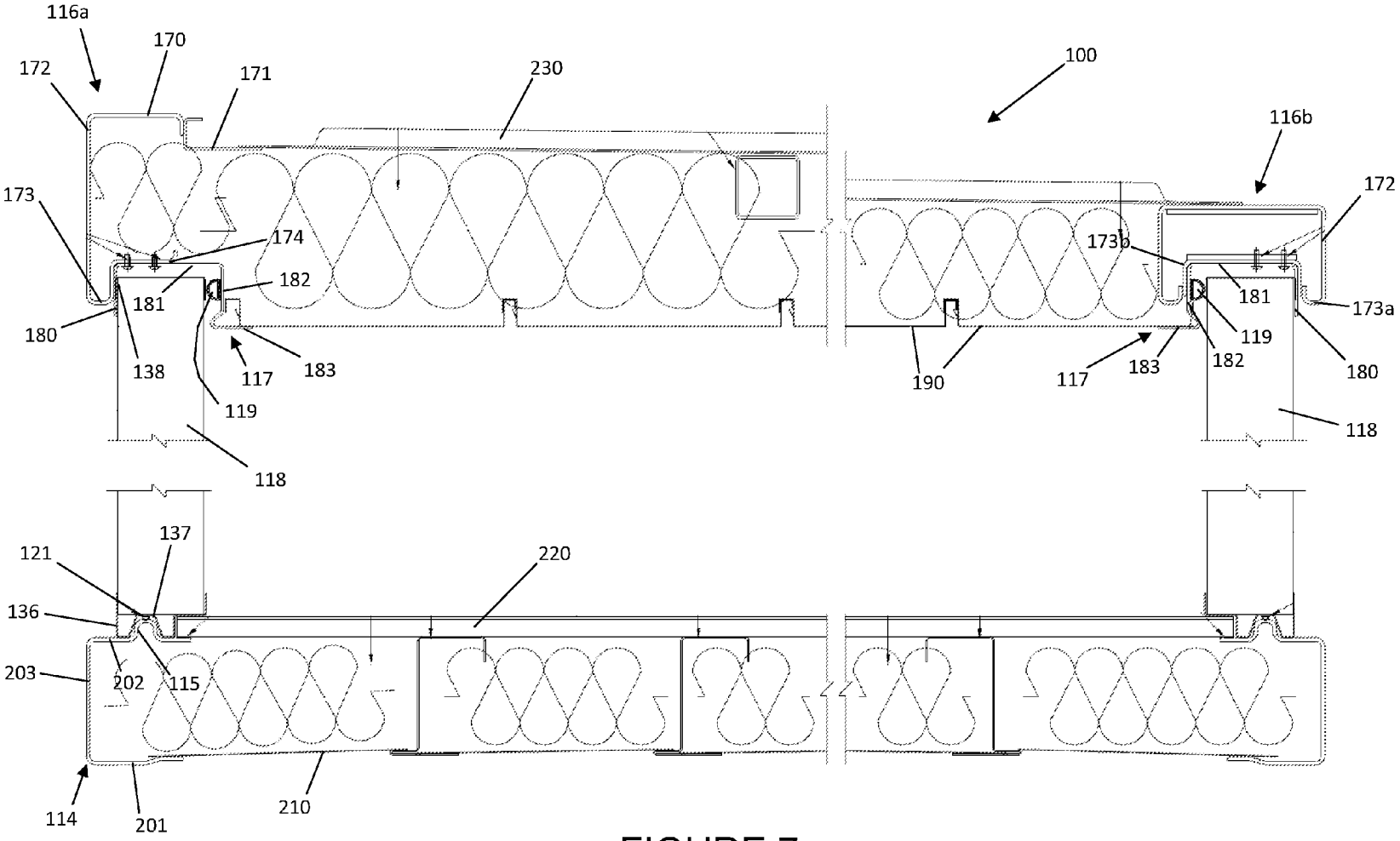
FIG. 7 is a cross-sectional view of wall panels of FIG. 4 installed on the frame of the modular building unit of FIG. 1.

FIG. 7 shows a cross-sectional view of wall panels 118 installed on the frame of the modular building unit 100. As shown in FIG. 7, a first top rail **116*a*** of the frame of the modular building unit has a generally horizontal top face 170, an inner roof supporting flange 171 supporting roofing sheet 230, a generally vertical exterior face 172 extending downward from a top, outer edge of top face 170, a u-shaped hook portion 173 turning inward at the bottom of exterior face 172, and an interior horizontal wall 174 extending into modular building unit 100 from the top, interior portion of u-shaped hook portion 173. A ceiling tray end bracket 117 is affixed to first top rail 116*a* along interior horizontal wall 174. Ceiling tray end bracket 117 has an outer vertical wall 180, a top horizontal wall 181, an interior vertical wall 182, and an interior horizontal wall 183. Outer vertical wall 180 is positioned against the interior face of u-shaped hook portion 173 of first top rail 116*a*, and thus sits in contact with each wall panel 118 at its upper, outer edge. Ceiling tray end bracket 117 is affixed to first top rail 116*a* by fasteners, such as screws, bolts, or the like, joining interior horizontal wall 174 of first top rail 116*a* to top horizontal wall 181 of ceiling tray end bracket 117. However, u-shaped hook portion 173 of first top rail 116*a* is dimensioned to position the top horizontal wall 181 of ceiling tray end bracket 117 a distance away from the top edge, and particularly top profile 138, of wall panel 118, thus providing an opening into which the top of panel 118 may be lifted to assist in installation, adjustment, and removal of wall panel 118 from the frame, as discussed in greater detail below.

Interior vertical wall 182 of ceiling tray end bracket 117 extends downward from an interior end of top horizontal wall 181, and includes a gasket 119 or other similarly configured flexible sealing member to provide a water-tight seal between the frame of the modular building unit 100 and the top of each wall panel 118.

Further, interior horizontal wall 183 of ceiling tray end bracket 117 extends inward from a bottom end of interior vertical wall 182, and supports an end of interlocking ceiling tiles 190 that form the ceiling of the interior of modular building unit 100.

With continued reference to FIG. 7, an opposite top rail 116*b* may be provided having a slightly modified construction from that of 116*a*, in which exterior u-shaped portion 173*a* attaches to an interior u-shaped bracket 173*b*, and in which top rail 116*b* joins directly to roofing sheet 230 instead of by way of a supporting flange, in order to provide a slant of roofing sheet 230 from one end of the modular building unit to the other for control of water flow on the roof. Nonetheless, the configuration of the underside of top rail 116*b* that receives the top portion of a wall panel 118 is identical to that described above, with interior u-shaped bracket 173*b* receiving top horizontal wall 181 of ceiling tray end bracket 117, and with interior horizontal wall 183 of ceiling tray end bracket 117 receiving the opposite end of interlocking ceiling tiles 190.

The details of the configuration and attachment of roofing sheet 230 to the rest of the frame of the modular building unit are set forth in detail in copending and co-owned U.S. patent application Ser. No. 14/801,989 titled "Welded Roof for Modular Building Units," the specification of which is incorporated herein by reference in its entirety.

With continued reference to FIG. 7, bottom rail 114 includes an exterior face 203 forming an exterior, bottom horizontal portion of the modular building unit 100, a bottom leg 201 extending inwardly from the bottom of exterior face 203 and having an upwardly angled distal end that supports subflooring sheets 210 of the modular building unit 110 above the plane of the ground, and a top leg 202 extending inwardly from the top of exterior face 203. Ridge 115 extends upward from top leg 202 of bottom rail 114, which ridge 115 is configured to mate with notch 137 on bottom profile 136 of wall panel 118. Top leg 202 then runs further inward from ridge 115, supporting both a back, bottom portion of bottom profile 136, and the bottom of a flooring panel 220 on the interior of modular building unit 100, such that flooring member 220 is positioned between internal ledge 164 of bottom profile 136 and the distal end of top leg 202 of bottom rail 114. This construction serves to both hold the bottom of panel 118 in place against movement into or away from the interior of modular building unit 100, and likewise holds an end of flooring panels 220 in place.

Further, a rubber gasket 121 may be provided between notch 137 and ridge 115 to provide additional sealing of the wall assembly.

When joined as detailed above, ridge 115 and notch 137 serve to hold the bottom of wall panel 118 in place on the frame of the modular building unit 100. Likewise, the vertical gap between the top of wall panel 118 and ceiling tray end bracket 117 allows removal and adjustment of the wall panels 118 within the frame by allowing panel 118 to be lifted so that the bottom profile 136 of wall panel 118 may clear ridge 115 on bottom rail 114, so that in turn the bottom of the panel 118 may be pulled outward and the entire panel moved or removed from the modular building unit 100.

The foregoing configuration results in a modular building construction having interlocking wall panels that mate with one another and with the frame of the building unit without screws, bolts or other fasteners, but while ensuring a water-tight fit. This configuration significantly simplifies installation of the wall panels into the skeletal frame of the modular building unit, allowing a first wall panel to be joined to an adjacent wall panel in a quick and easy installation step while maintaining the ability to later adjust and/or replace the wall panel.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

The invention claimed is:

1. An interlocking wall panel system for modular building units, comprising:

a plurality of wall panels of identical construction, each said wall panel further comprising:

an external sheet and an internal sheet;

a vertical tongue extending along a first vertical edge of said wall panel and formed by a first edge of each of said external sheet and said internal sheet;

a vertical groove extending along a second vertical edge of said wall panel and formed by a second edge of each of said external sheet and said internal sheet, wherein said vertical groove of a first one of said panels is configured to mate with said vertical tongue of an adjacent one of said panels to form a connected edge in which said external sheets of said adjacent panels are in contact and coplanar with one another, and said internal sheets of said adjacent panels are in contact and coplanar with one another; and a bottom profile having an upwardly extending notch configured to engage an upwardly extending ridge on a lower frame member of a modular building unit, wherein said bottom profile further comprises a front wall adjacent said external sheet, a back wall adjacent said internal sheet, an internal ledge extending from a bottom end of said back wall and toward the front wall of said wall panel, a vertical wall extending downward away from said wall panels from said internal ledge, and a a bottom wall having the upwardly extending notch therein, the bottom wall between said front wall and said vertical wall;

wherein said vertical tongue of each of said wall panels further comprises:

a first inwardly bent leg bending toward an interior of said wall panel at a first end of an outer face of the external sheet and an external side tongue wall extending outward from an end of said leg, and a second inwardly bent leg bending toward an interior of said wall panel at a first end of an interior face of the internal sheet and an internal side tongue wall extending outward from an end of said second leg.

2. The interlocking wall panel system of claim 1, said vertical groove of each said wall panel further comprising:

an external groove wall extending outward from a second end of the outer face of the external sheet, said external groove wall having an external face configured to align with the external sheet of said adjacent one of said panels, an internal face configured for facing engagement with said external side tongue wall of said adjacent one of said panels, and a rounded end portion configured to abut said first inwardly bent leg of said adjacent one of said panels; and an internal groove wall extending outward from a second end of the interior face of the internal sheet, said internal groove wall having an external face configured to align with the internal sheet of said adjacent one of said panels, an internal face configured for facing engagement with said internal side tongue wall of said adjacent one of said panels, and a rounded end portion configured to abut said second inwardly bent leg of said adjacent one of said panels.

3. The interlocking wall panel system of claim 1, each of said wall panels further comprising a top profile defining an outer rectangular perimeter configured to fit within a rectangular opening in an upper frame member of a modular building unit.

4. The interlocking wall panel system of claim 3, each of said wall panels further comprising an insulation panel positioned between said external sheet and said internal sheet.

5. The interlocking wall panel system of claim 4, said top profile further comprising a horizontal top face, a first planar top wall extending downward from said horizontal top face and positioned between said external sheet and said insulation panel, and a second planar top wall extending downward from said horizontal top face and positioned between said internal sheet and said insulation panel.

6. The interlocking wall panel system of claim 1, said notched wall further comprising a first bottom wall section extending from a bottom of said front wall and a second bottom wall section extending from a bottom of said vertical wall, a horizontal ledge positioned between said first bottom wall section and said second bottom wall section and horizontally aligned with said internal ledge, and angled walls extending from each of said first bottom wall section and said second bottom wall section to said horizontal ledge.

7. A modular building unit comprising:

a rigid, fixed modular building unit frame having a plurality of corner support posts, a bottom rail extending between adjacent pairs of corner support posts, a top rail extending between adjacent pairs of corner support posts, and a plurality of wall panels extending between said corner support posts, said top rails, and said bottom rails;

wherein each said wall panel further comprises:

an external sheet and an internal sheet;

a vertical tongue extending along a first vertical edge of said wall panel and formed by a first edge of each of said external sheet and said internal sheet;

a vertical groove extending along a second vertical edge of said wall panel and formed by a second edge of each of said external sheet and said internal sheet, wherein said vertical groove of a first one of said panels is configured to mate with said vertical tongue of an adjacent one of said panels to form a connected edge in which said external sheets of said adjacent panels are in contact and coplanar with one another, and said internal sheets of said adjacent panels are in contact and coplanar with one another; and a bottom profile having an upwardly extending notch configured to engage an upwardly extending ridge on said bottom rail of said modular building unit frame.

8. The modular building unit of claim 7, said vertical tongue of each of said wall panels further comprising:

a first inwardly bent leg bending toward an interior of said wall panel at a first end of an outer face of the external sheet and an external side tongue wall extending outward from an end of said leg, and a second inwardly bent leg bending toward an interior of said wall panel at a first end of an interior face of the internal sheet and an internal side tongue wall extending outward from an end of said second leg.

9. The modular building unit of claim 8, said vertical groove of each said wall panel further comprising:

an external groove wall extending outward from a second end of the outer face of the external sheet, said external groove wall having an external face configured to align with the external sheet of said adjacent one of said panels, an internal face configured for facing engagement with said external side tongue wall of said adjacent one of said panels, and a rounded end portion configured to abut said first inwardly bent leg of said adjacent one of said panels; and an internal groove wall extending outward from a second end of the interior face of the internal sheet, said internal groove wall having an external face configured to align with the internal sheet of said adjacent one of said panels, an internal face configured for facing engagement with said internal side tongue wall of said adjacent one of said panels, and a rounded end portion configured to abut said second inwardly bent leg of said adjacent one of said panels.

10. The modular building unit of claim 7, each of said wall panels further comprising a top profile defining an outer rectangular perimeter configured to fit within a rectangular opening in said top rail of said modular building unit frame.

11. The modular building unit of claim 10, each of said wall panels further comprising an insulation panel positioned between said external sheet and said internal sheet.

12. The modular building unit of claim 11, said top profile further comprising a horizontal top face, a first planar top wall extending downward from said horizontal top face and positioned between said external sheet and said insulation panel, and a second planar top wall extending downward from said horizontal top face and positioned between said internal sheet and said insulation panel.

13. The modular building unit of claim 7, said bottom profile further comprising a front wall adjacent said external sheet, a back wall adjacent said internal sheet, an internal ledge extending from a bottom end of said back wall and toward an interior of said wall panel, a vertical wall extending downward from said internal ledge, and a notched wall between said front wall and said vertical wall.

14. The modular building unit of claim 13, said notched wall further comprising a first bottom wall section extending from a bottom of said front wall and a second bottom wall section extending from a bottom of said vertical wall, a horizontal ledge positioned between said first bottom wall section and said second bottom wall section and horizontally aligned with said internal ledge, and angled walls extending from each of said first bottom wall section and said second bottom wall section to said horizontal ledge.

* * * * *